US005944480A

United States Patent [19]

Forrest

[11] Patent Number: 5,944,480

[45] Date of Patent: Aug. 31, 1999

[54] BUOYANCY AND GRAVITATION MOTOR

[76] Inventor: Brad A. Forrest, 93 Van Wagner Rd., Poughkeepsie, N.Y. 12603

[21] Appl. No.: 09/013,103

[22] Filed: Jan. 26, 1998

[51] Int. Cl.[6] ..... F01D 23/00; F03B 9/00

[52] U.S. Cl. ..... 415/5; 415/6; 415/916

[58] Field of Search ..... 415/5, 6, 916; 60/495, 496; 416/7

[56] References Cited

U.S. PATENT DOCUMENTS

| | | | |
|---|---|---|---|
| 322,785 | 7/1885 | Bradway . | |
| 1,261,634 | 4/1918 | Slingland | 415/5 |
| 1,389,428 | 8/1921 | Gartling . | |
| 1,708,807 | 4/1929 | Tatay | 415/916 X |
| 2,037,973 | 4/1936 | Grondahl | 60/496 |
| 3,194,008 | 7/1965 | Baumgartner . | |
| 4,242,868 | 1/1981 | Smith . | |
| 4,718,232 | 1/1988 | Willmouth | 60/495 |
| 4,742,242 | 5/1988 | DeShon . | |

FOREIGN PATENT DOCUMENTS

| | | | |
|---|---|---|---|
| 169481 | 3/1905 | Germany | 415/5 |
| 3816133 | 12/1989 | Germany | 415/5 |
| 3-121274 | 5/1991 | Japan | 415/5 |
| 6-123273 | 5/1994 | Japan | 415/5 |

OTHER PUBLICATIONS 119,312 BUSBY's Complete Specification 5 sheets, Apr. 1936.

*Primary Examiner*—John Ryznic
*Attorney, Agent, or Firm*—Joseph L. Spiegel

[57] ABSTRACT

A motor that combines buoyant and gravitational forces to create a highly efficient limitless source of energy comprises: a reservoir containing liquid; a vertical cylinder in communication with, extending from the liquid reservoir, containing liquid and having a top and a bottom; a continuous chain extending vertically through the fluid contained in the vertical cylinder, the chain including a plurality of floats spaced along and linked together by connecting cable, each float having an external cup that carries a small amount of liquid to the top of the cylinder and discharges the liquid back into the cylinder as the float exits same; an upper sprocket wheel around which the continuous chain travels and where the direction of the continuous chain changes from upward away from the top of the vertical cylinder to downward through ambient air; a lower sprocket wheel around which the continuous chain travels and where the direction of the continuous chain changes from downward to upward into the bottom of the vertical cylinder; an upper valve at the top of the vertical cylinder through which the float containing continuous chain passes; a lower valve disposed within the liquid reservoir at the bottom of the vertical cylinder through which the float containing continuous chain passes; an upper cam assembly actuated by the upper sprocket wheel for operating the upper valve; and, a lower cam assembly actuated by the lower sprocket wheel for operating the lower valve. Each valve is open when the other is closed. When the top valve is open and the lower valve is closed, the cylinder is nothing more than a container with an open top and a sealed bottom. With the top valve closed and the lower valve open, because the lower valve is below the liquid level in the liquid reservoir, a vacuum-like condition is created thereby preventing the escape of the liquid from the vertical cylinder.

2 Claims, 3 Drawing Sheets

BUOYANCY AND GRAVITATION MOTOR

BACKGROUND OF INVENTION

1. Field of Invention

The present invention relates to a buoyancy and gravitational motor.

2. Description of Prior Art

Bradway, U.S. Pat. No. 322,785, pertains to a water motor utilizing a tube through which buckets on an endless chain pass, the tube having a series of levels at different openings, and a tubular valve sleeved thereon for controlling the openings.

In Slingland, U.S. Pat. No. 1,261,634, upwardly moving air is used to drive propelling members on an endless belt.

Gartling, U.S. Pat. No. 1,389,428, discloses a cable pump having an endless cable with buckets passing upwardly through a water containing suction barrel. The pump is driven from a power source not shown.

Tatay, U.S. Pat. No. 1,708,807, relates to a device with a plurality of floats arranged along a continuous chain which passes through a vertical water containing tube and a compressed air source for directing air and selectively varying the rotation of a wheel about which the chain turns.

The U.S. Pat. No. 2,037,973 to Grondahl, relates to a hydro-power generator that uses a series of water-and air-light compartments that pass upwardly through a body of water contained within a tank to thereby rotate a wheel or pulley and create the power desired. The generator utilizes a single valve at the bottom of the tank. The generator depends upon the availability of a continuous supply of fluid to make up the loss of each cycle of the valve.

Baumgartner, U.S. Pat. No. 3,194,008, describes a buoyancy motor utilizing a hollow buoyancy ring and with a gas pressurized plenum chamber through which the rings pass for controlling speed.

In Smith, U.S. Pat. No. 4,242,868, the kinetic force of both flowing or falling water as well as the buoyant force of a body of water upon exposed inflatable/deflatable bellows on an endless belt is used to turn the belt. A compressor is required to inflate the bellows.

The U.S. Pat. No. 4,718,232 to Willmouth, discloses a gravity and buoyancy driven chain ultimately used to drive an electrical power generator. It requires an outside source of power for operation of a compressor for initial start up, which compressor continues to consume power during operation.

In De Shon, U.S. Pat. No. 4,742,242, a buoyancy engine with linked buoyant lifting bodies is described. The engine utilizes compressed air and a computer controller. It also utilizes air injectors to reintroduce the floats into the fluid which consume power and limit the ultimate size of the engine.

SUMMARY OF INVENTION

An object of the invention is a buoyancy and gravitational motor that is simple in construction, highly efficient and creates a rotary motion which energy may be transmitted via a shaft to rotate an electric generator or other device.

Another object is such a motor that does not require a continuous source of fluid.

Still another object is such a motor that does not require an external power source, consume fuel or create a waste by-product.

These and other objects, features and advantages of the present invention are accomplished in accordance with the teachings of the present invention, one illustrative embodiment of which comprises a buoyant and gravitational force motor, including: a reservoir containing liquid; a vertical cylinder in communication with, extending from the liquid reservoir, containing liquid and having a top and a bottom; a continuous chain extending vertically through the liquid contained in the vertical cylinder, the chain including a plurality of floats spaced along and linked together by connecting cable, each float having an external cup that carries a small amount of liquid to the top of the cylinder and discharges the liquid back into the cylinder as the float exits same; an upper sprocket wheel around which the continuous chain travels and where the direction of the continuous chain changes from upward away from the top of the vertical cylinder to downward through ambient air; a lower sprocket wheel around which the continuous chain travels and where the direction of the continuous chain changes from downward to upward into the bottom of the vertical cylinder; an upper valve at the top of the vertical cylinder through which the float containing continuous chain passes; a lower valve disposed within the liquid reservoir at the bottom of the vertical cylinder through which the float containing continuous chain passes; an upper cam assembly actuated by the upper sprocket wheel for operating the upper valve; and, a lower cam assembly actuated by the lower sprocket wheel for operating the lower valve. Each valve is open when the other is closed. When the top valve is open and the lower valve closed, the cylinder is nothing more than a container with an open top and a sealed bottom. With the top valve closed and the lower valve open, because the lower valve is below the liquid level in the liquid reservoir, a vacuum-like condition is created thereby preventing the escape of the liquid from the vertical cylinder.

BRIEF DESCRIPTION OF THE DRAWING

Other objects, features and advantages of the invention will be apparent from the following detailed description and accompanying drawing, wherein.

DETAILED DESCRIPTION

Figure 1:
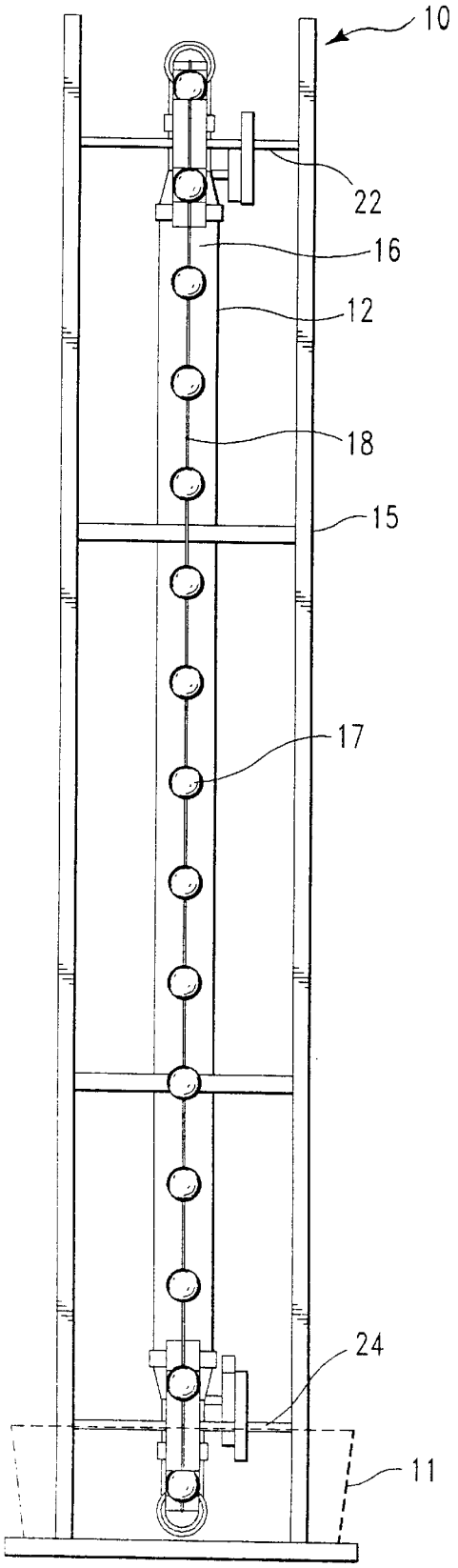
FIG. 1 is a schematic side view of the buoyancy and gravitation motor of the present invention.
Figure 2:
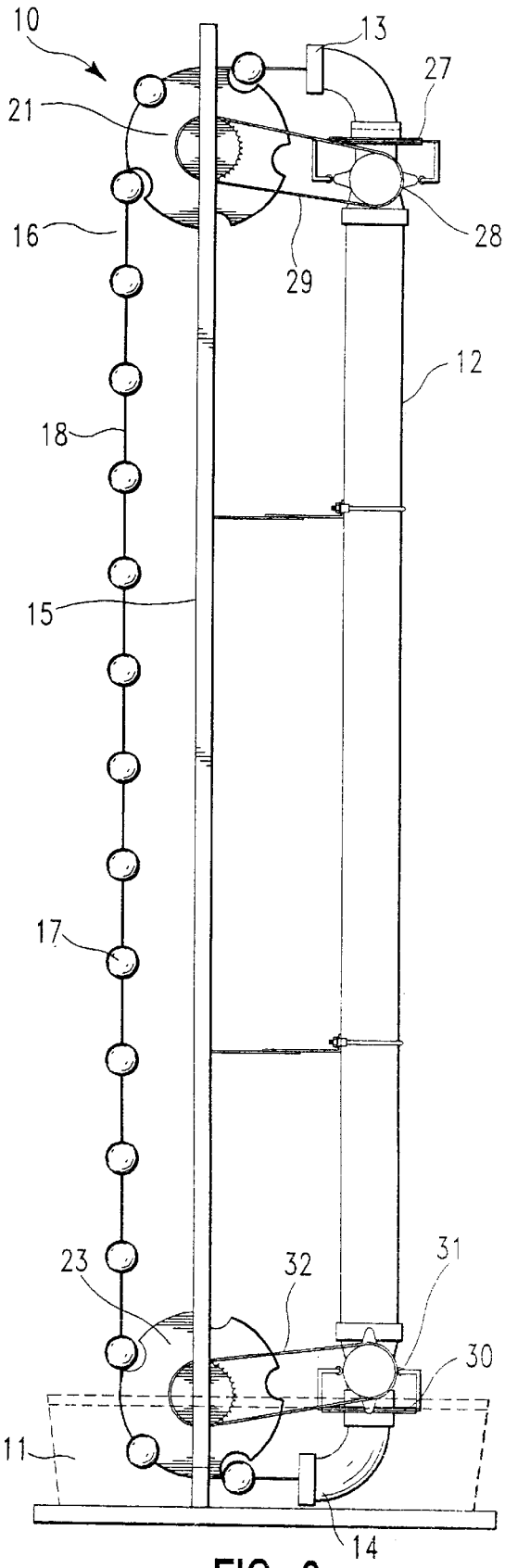
FIG. 2 is a schematic front view of the buoyancy and gravitational motor of the present invention.

Referring to FIGS. 1 and 2 of the drawing, a motor that combines buoyant and gravitational forces is disclosed.

The motor 10 is seen as including a reservoir 11 containing liquid. The liquid normally is water but another liquid with better buoyancy characteristics can be used.

A vertical cylinder 12 is in communication with the liquid containing reservoir 11, extends upwardly there from and contains liquid. The top of the cylinder is denoted by the numeral 13 while its bottom is denoted by the numeral 14. A structure 15 acts as an overall support for the motor.

A continuous chain 16 extends vertically through the liquid in the cylinder 12 and includes a plurality of steel floats 17 spaced along and linked together by connecting cables 18.

Each float 17 has an external cup that carries a small amount of liquid to the top of the cylinder and discharges the liquid back into the cylinder 12 as the float exits same.

The diameter of the float 17 is slightly less than the diameter of the cylinder 12 to allow the floats 17 to move freely through the cylinder 12. This will minimize the weight and pressure of the liquid on the valves to be described hereafter.

An upper sprocket wheel 21 mounted on a shaft 22 supported on the structure 15 and around which the continuous chain 16 travels defines the point where the direction of the continuous chain 16 changes from upward away from the top 13 of the cylinder 12 to downward through ambient air.

A similar sprocket wheel 23 mounted on a shaft 24 supported on the lower part of the structure 15 and around which the continuous chain 16 travels defines the point where the direction of the continuous chain 16 changes from downward to upward into the bottom 14 of the cylinder.

The motor 10 is further provided with an upper valve 27 and cam assembly 28 linked to upper sprocket wheel 21 by chain 29 at the top portion of the cylinder 12 through which the float containing continuous chain 16 passes, and a lower valve 30 and cam assembly 31 submerged in the reservoir liquid and disposed at the bottom portion of the cylinder 12 through which the float containing continuous chain 16 passes and linked to the lower sprocket wheel 23 by chain 32. The floats 17 will pass through the valves 27, 30 freely with minimum fluid loss.

Figure 3:
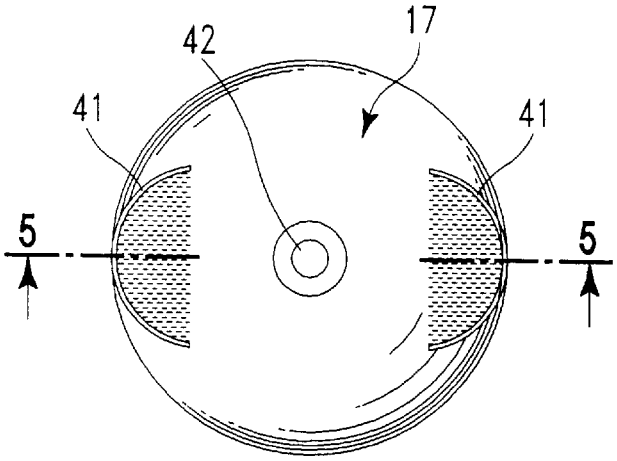
FIG. 3 is a top view of a float constructed in accordance with the teachings of the present invention.
Figure 4:
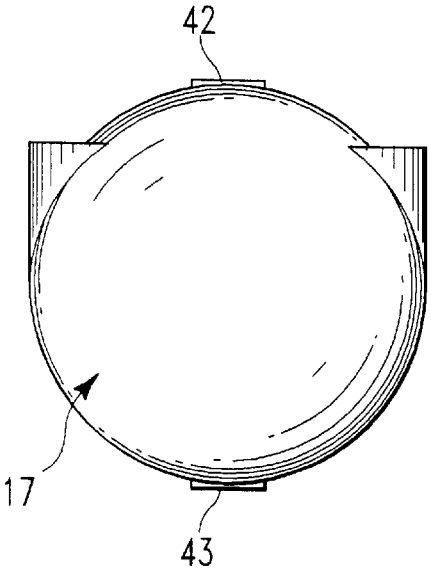
FIG. 4 is a side view of the float of FIG. 3.
Figure 5:
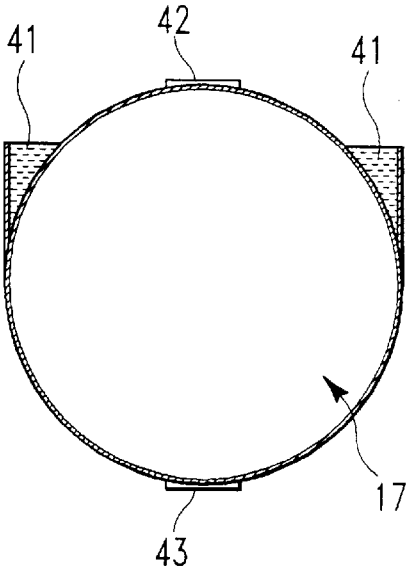
FIG. 5 is a section taken along the line 5 5 of FIG. 3.

The float 17 utilized in the present, is seen in FIGS. 3–5 as including the external cups 41. The points of connection to cable 18 are shown at 42 and 43.

Figure 6:
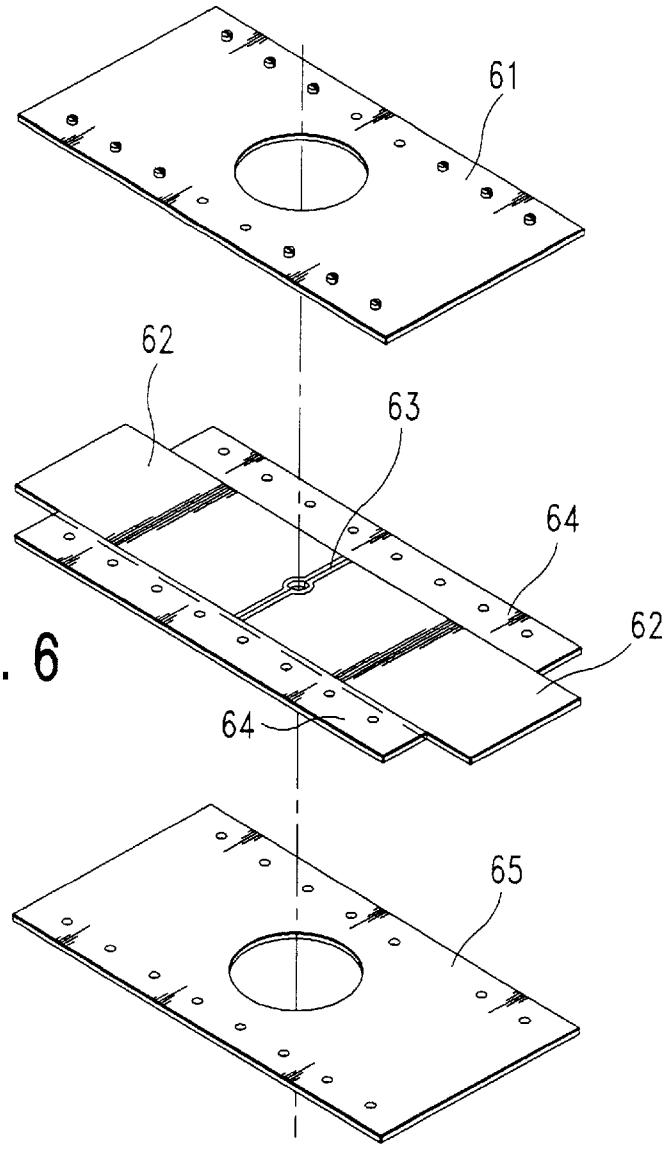
FIG. 6 is an exploded view of a typical valve used at the top and bottom of the vertical cylinder; and, FIG. 7 is an isometric view of the valve shown in FIG. 6.
Figure 7:
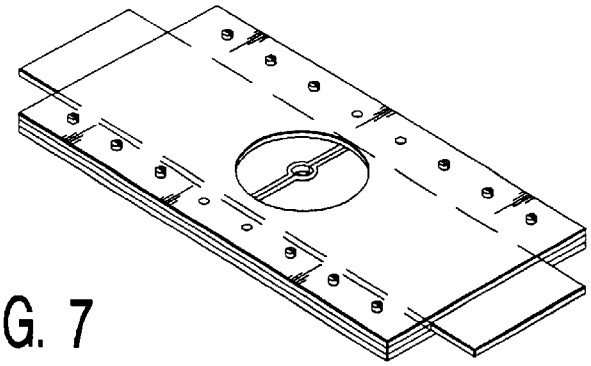

Different type valves may be used. By way of example, as seen in FIGS. 6 and 7, the valves may be made of two gates 62 which operate between a top plate 61 and a bottom plate 65. These plates are held apart by the valve gate guides 64. The opposite edges of the gates 62 are in constant contact while the valve is in the closed position. These edges have a rubber seal 63 that ensures that a tight seal is made when closed and prevents any leakage around the valve gate edges when open. Each gate has a semi-circle shape at its midpoint on the before mentioned edges to allow the passage of the connecting cable while maintaining a snug fit about the cable while the valve is closed.

The chain 29 coming off the upper sprocket wheel 21 drives the cam assembly 28 of the upper valve 27 while the chain 32 coming off the lower sprocket wheel 23 drives the cam assembly 31 of the lower valve 30.

The way the valves, 27, 30 operate eliminates the need for a constant water source or compressed air. A sequence of the opening and closing of the valves 27, 30 through a complete cycle will now be described.

For initial startup the lower valve 30 is completely closed and the top valve 27 is fully open. At this point the cylinder 12 is nothing more than a container with a sealed bottom and an open top. The liquid reservoir 11 is filled to a level just above the lower valve 30. Now the cylinder 12 can be filled. At some point as the cylinder 12 is filling, the effect of buoyancy on the submerged floats 17 generates enough force to overcome the weight of the floats 17 not yet submerged and motion begins. Alternatively, braking pressure can be applied to the sprocket wheels 21, 23 and not released until operation of the motor 10 is desired. The cylinder 12 is filled to a level just above the top valve 27.

As motion begins, the floats 17 and connecting cable 18 turn the sprocket wheels 21, 23 operating the valve cam assemblies 28, 31. The floats 17 engage into the recesses on the sprocket wheels 21, 23. A float 17 passes through the open upper valve 27. At the closed lower valve 30 the connecting cable 18 slides through a seal in the lower valve 30. It is necessary that as the connecting cable 18 passes through the valves 27, 30 a good seal be made. The connecting cable 18 may be of the plastic or rubber coated type that allows the seals on the valves to seal tightly against it.

As the horizontal centerline of the float 17 passes the upper valve 27, the upper valve cam assembly 28 causes the upper valve 27 to begin to close. The valve 27 continues to close until the float 17 is past the upper valve 27 at which point the upper valve 27 is completely closed. The floats 17 continue to rise in the cylinder 12 and the connecting cable 18 slides through the now closed upper valve 27.

At this point with the upper valve 27 completely closed, the lower valve 30 being operated by the lower valve cam assembly 31 begins to open. The lower valve 30 reaches its maximum opening when the horizontal centerline of the float 17 passes the lower valve 30. At this point the cylinder 12 is similar to a bottle filled with water inverted into a tub of water. No water can escape the inverted bottle because air cannot enter the bottle.

With the horizontal centerline of the float 17 having passed the lower valve 30, the lower valve cam assembly 31 begins to close the lower valve 30.

When the lower valve 30 is completely closed the upper valve cam assembly 28 begins to open the upper valve 27 and a float 17 starts to pass the upper valve 27. The upper valve 27 reaches its maximum opening when the horizontal centerline of the float 17 passes the upper valve 27. This completes one cycle of the sequence of opening and closing of the valves.

It is important that before one valve opens the other valve is completely closed. This can be defined in a special relationship between the floats and valves. Let D equal the distance between the center of one float and the center of the next float. Let L equal the length of the float at the centerline of the connecting cable ends. Where the float is a sphere L equals the diameter of the sphere. Let N equal the number of floats in the cylinder between the top valve and lower valve. The distance then between the valves is equal to $(N-1)D+L$. The motor becomes more efficient as D decreases, with the minimum value of D being 2L.

In operation, the upper buoyant forces exerted by the liquid on the floats 17 is the key force to generate energy. When the floats 17 turn about the upper sprocket wheel 21 their direction is now downward and the second force, gravitational force, comes into play. The cycle repeats continuously.

The key to the operation of the motor is keeping the liquid in the cylinder and this is accomplished through the sequencing of the valves. The liquid level in the reservoir is maintained such that the lower valve 30 is continuously submerged in liquid. This creates a vacuum-like condition when the top valve 27 is closed and the bottom valve 30 is opened. This condition will keep the liquid from escaping the cylinder.

The valve cam assembly operation, sprocket wheels and floats traveling through the cylinder will, of course, absorb some of the energy created.

Motion is initiated by first filling the reservoir and then the cylinder with liquid. As the cylinder fills, the floats in the cylinder begin to rise and normal valve operation begins. Once the cylinder is filled, continuous motion will be realized. The cylinder can be emptied or braking pressure applied to the sprocket wheels to stop motion.

It should be obvious that changes, additions and omissions may be made in the details and arrangement of parts without departing from the scope of the invention as defined.

What is claimed is:

1. In a motor that combines buoyant and gravitational forces to create a rotary motion and which relies upon the upward buoyant action of a liquid, contained within a vertical cylinder upon floats spaced along the length of continuous chain which passes through the bottom of the cylinder, liquid in the cylinder and top of the cylinder, the improvement comprising:

an upper valve at the top of the cylinder; and, a lower valve at the bottom of the cylinder, each valve being open when the other is closed to create a vacuum within the cylinder when the bottom valve is open thereby preventing the escape of liquid when the bottom valve is open.

2. A motor that combines buoyant and gravitational forces to create rotary motion comprising:

a reservoir containing liquid;

a vertical cylinder in communication with, extending from the liquid reservoir, containing liquid and having a top and a bottom;

a continuous chain extending vertically through the liquid contained in the vertical cylinder;

a plurality of floats spaced along the length of the continuous chain and having an external cup that carries a small amount of fluid to the top of the cylinder and discharges the fluid back into the cylinder as the float exits same;

an upper sprocket wheel around which the continuous chain travels and where the direction of the continuous chain changes from upward away from the top of the vertical cylinder to downward through ambient air;

a lower sprocket wheel around which the continuous chain travels and where the direction of the continuous chain changes from downward to upward into the bottom of the vertical cylinder;

an upper valve at the top of the vertical cylinder through which the float containing continuous chain passes;

a lower valve disposed within the fluid reservoir at the bottom of the vertical cylinder through which the float containing continuous chain passes;

an upper cam assembly actuated by the upper sprocket wheel for operating the upper valve; and, a lower cam assembly actuated by the lower sprocket wheel for operating the lower valve;

each valve being open when the other is closed to create a vacuum within the vertical cylinder when the bottom valve is open thereby preventing the escape of fluid from the vertical cylinder.

* * * * *